US006908133B1

(12) United States Patent
Morton et al.

(10) Patent No.: US 6,908,133 B1
(45) Date of Patent: Jun. 21, 2005

(54) DEVICE FOR PREVENTING EMERGENCY VEHICLE BUMPER INTERFERENCE WITH COT WHEEL DEPLOYMENT

(75) Inventors: Gary Morton, Kalamazoo, MI (US); Steve Knipfel, Portage, MI (US); Jason Kneen, Mattawan, MI (US)

(73) Assignee: Stryker Corporation, Kalamazoo, MI (US)

( * ) Notice: Subject to any disclaimer, the term of this patent is extended or adjusted under 35 U.S.C. 154(b) by 76 days.

(21) Appl. No.: 10/850,144

(22) Filed: May 20, 2004

(51) Int. Cl.[7] ..... A61G 20/00
(52) U.S. Cl. ..... 296/19
(58) Field of Search ..... 296/19, 20; 5/81.1 R, 5/86.1, 611, 424

(56) References Cited

U.S. PATENT DOCUMENTS

| | | | | |
|---|---|---|---|---|
| 1,477,815 A | * | 12/1923 | Denning | 296/19 |
| 3,955,847 A | * | 5/1976 | Schiowitz | 296/19 |
| 4,957,121 A | * | 9/1990 | Icenogle et al. | 296/19 |
| 5,135,350 A | * | 8/1992 | Eelman et al. | 296/20 |
| 5,537,700 A | | 7/1996 | Way et al. | |
| 5,913,559 A | * | 6/1999 | Sexton et al. | 296/20 |
| 6,024,528 A | * | 2/2000 | Taylor | 296/20 |
| 6,332,638 B1 | * | 12/2001 | Menna | 296/20 |

FOREIGN PATENT DOCUMENTS

| | | | | |
|---|---|---|---|---|
| DE | 3711048 A1 | * | 10/1988 | 296/20 |
| FR | 2558056 A1 | * | 7/1985 | 296/20 |

* cited by examiner

*Primary Examiner*—Lori L. Coletta
(74) *Attorney, Agent, or Firm*—Flynn, Thiel, Boutell & Tanis, P.C.

(57) ABSTRACT

A safety stop member which consists of an L-shaped member, plural fasteners for fastening a first leg of the L to the floor surface, a second leg of the L being oriented in an upstanding relation relative to the first leg and to the floor surface and configured so that the upstanding second leg will interfere with and engage a safety bar on an emergency cot only when the safety bar is positioned adjacent a juncture between the first and second legs. An outwardly facing side of the second leg is oriented generally flush with an edge of the access opening so that when the emergency cot extends outwardly from the access opening in the cargo area and the safety bar engages the second leg, the base on the emergency cot will be sufficiently spaced outwardly of an outermost facing surface of a step bumper on the emergency vehicle to facilitate an unobstructed deployment of the base to the deployed position thereof.

5 Claims, 5 Drawing Sheets

10
11
12
13
14
20
21
22
28
30
31
32
37
1
2
3
4
6
7
X
IV
V 10
12
11
31
13
37
14
16
21
18
36
17
D
30
34
33
1
4
20
X
32
22
23
26
28
Y
24
27

DEVICE FOR PREVENTING EMERGENCY VEHICLE BUMPER INTERFERENCE WITH COT WHEEL DEPLOYMENT

FIELD OF THE INVENTION

This invention relates to a safety device for preventing an emergency cot from being uncontrollably deployed from a cargo area of an emergency vehicle and, more particularly, to a stop member oriented on a floor surface of the cargo area of an emergency vehicle and configured to interfere with a safety bar provided on the emergency cot as the emergency cot is moved with its wheels engaging the floor surface out of the cargo area to stop the outward movement while at least one wheel on the emergency cot still rests on the floor surface.

BACKGROUND OF THE INVENTION

It has been known to provide a safety stop member on a floor surface of a cargo area of an emergency vehicle and have it configured to interfere with a safety bar mechanism on an emergency cot as the emergency cot is moved with its wheels engaging the floor surface out of the cargo area to stop the outward movement while at least one wheel on the emergency cot still rests on the floor surface. A representative prior art mechanism is illustrated in FIG. 1. The safety stop member 1 is anchored to the floor surface 2 by a plurality of fasteners schematically illustrated at 3. The safety stop member 1 has a vertically upright surface 4 which faces inwardly of the cargo area of the emergency vehicle and faces away from the access opening into the cargo area. A conventionally provided safety bar 6 on an emergency cot engages the surface 4 as the emergency cot is moved with its wheels engaging the floor surface 2 out of the cargo area to stop the outward movement while at least one wheel on the emergency cot still rests on the floor surface 2. Typically, the fasteners 3 are oriented between the surface 4 and a rear edge 7 of the cargo area as depicted in FIG. 1. A handle mechanism (not illustrated in FIG. 1) on the emergency cot facilitates a movement of the safety bar to a location where continued movement of the emergency cot out of the cargo area will be facilitated without the safety bar interfering with the safety stop member 1.

It is to be noted in FIG. 1 that the surface 4 is spaced from the rear edge 7 of the cargo area by a distance represented by "X". This distance is typically in the range of 2 to 3.5 inches.

Emergency personnel are accustomed to entering the cargo area of an emergency vehicle through a rear access opening. A step area on top of a bumper is generally provided to facilitate the foot of the emergency personnel to be placed thereon during entrance and exit from the cargo area. There has been a desire on the part of emergency personnel to have present a wider step available to them as they enter and exit the cargo area. However, a wider step has created the problem of the collapsible base on the emergency cot engaging the step as the base is moved from its collapsed position to its deployed position. Thus, it is desirable to provide a safety stop member that will facilitate the continued use of standardized emergency cot configurations in situations where a wider step exists adjacent the access opening to the cargo area of an emergency vehicle.

Accordingly, it is an object of this invention to provide a safety stop member that is oriented on a floor surface of an emergency vehicle and is configured to interfere with a safety bar on an emergency cot as the emergency cot is moved with its wheels engaging the floor surface out of the cargo area to stop the outward movement of the emergency cot while at least one wheel on the emergency cot still rests on the floor surface.

It is a further object of the invention to provide a safety stop member, as aforesaid, wherein the safety stop member consists of an L-shaped member, a rearwardly facing surface of a vertical leg of the L being oriented generally flush with an edge at the access opening, the horizontal leg of the L being fastened to a floor surface of the cargo area by a plurality of fasteners.

It is a further object of the invention to provide a safety stop member, as aforesaid, wherein when the safety bar on an emergency cot engages the inwardly facing surface of the vertically upright leg of the L, at least one of the plural fasteners holding the safety stop member to the floor surface will be oriented on a side of the safety bar remote from the inwardly facing surface of the vertically upright leg.

It is a further object of the invention to provide a safety stop member, as aforesaid, wherein when the safety bar on an emergency cot engages the inwardly facing surface of the vertically upright leg of the L, all of the fasteners holding the safety stop member to the floor surface will be oriented on a side of the theoretical vertical center line of the safety bar remote from the inwardly facing surface of the vertically upright leg.

SUMMARY OF THE INVENTION

The objects and purposes of the invention are met by providing a safety stop member which consists of an L-shaped member, plural fasteners for fastening a first leg of the L to the floor surface, a second leg of the L being oriented in an upstanding relation relative to the first leg and to the floor surface and configured so that the upstanding second leg will interfere with and engage a safety bar on an emergency cot only when the safety bar is positioned adjacent a juncture between the first and second legs. An outwardly facing side of the second leg is oriented generally flush with an edge of the access opening so that when the emergency cot extends outwardly from the access opening in the cargo area and the safety bar engages the second leg, the base on the emergency cot will be sufficiently spaced outwardly of an outwardly facing surface of a step bumper on the emergency vehicle to facilitate an unobstructed deployment of the base to the deployed position thereof.

BRIEF DESCRIPTION OF THE DRAWINGS

Other objects and purposes of this invention will be apparent to persons acquainted with safety apparatus of this general type upon reading the following specification and inspecting the accompanying drawings, in which.

DETAILED DESCRIPTION

Figures 1, 2:
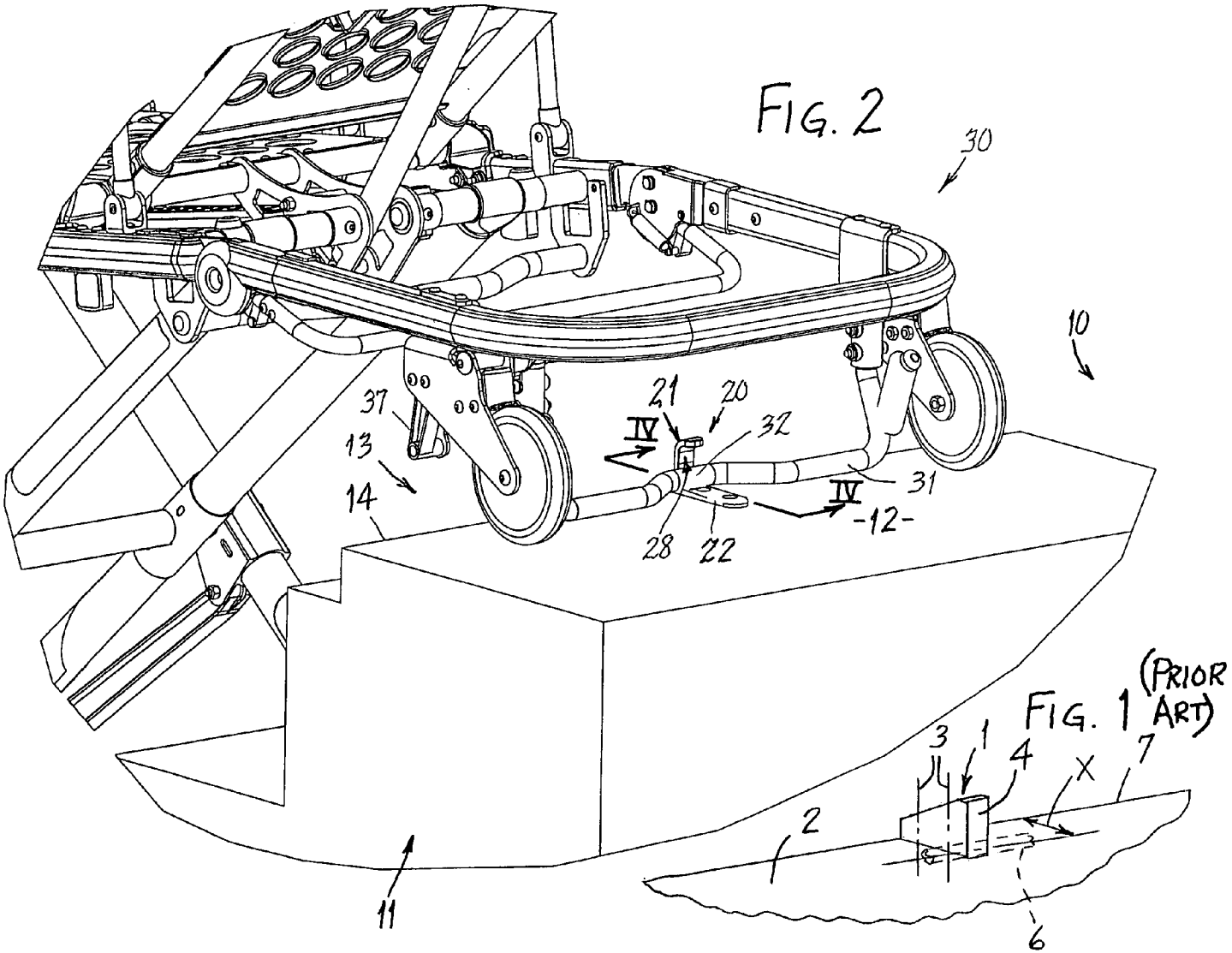
FIG. 1 (PRIOR ART)
FIG. 1 is an isometric view of a prior art safety stop member.
FIG. 2 is an isometric view of a safety bar on an emergency cot operatively engaging a safety stop member embodying the invention.
Figures 3, 4:
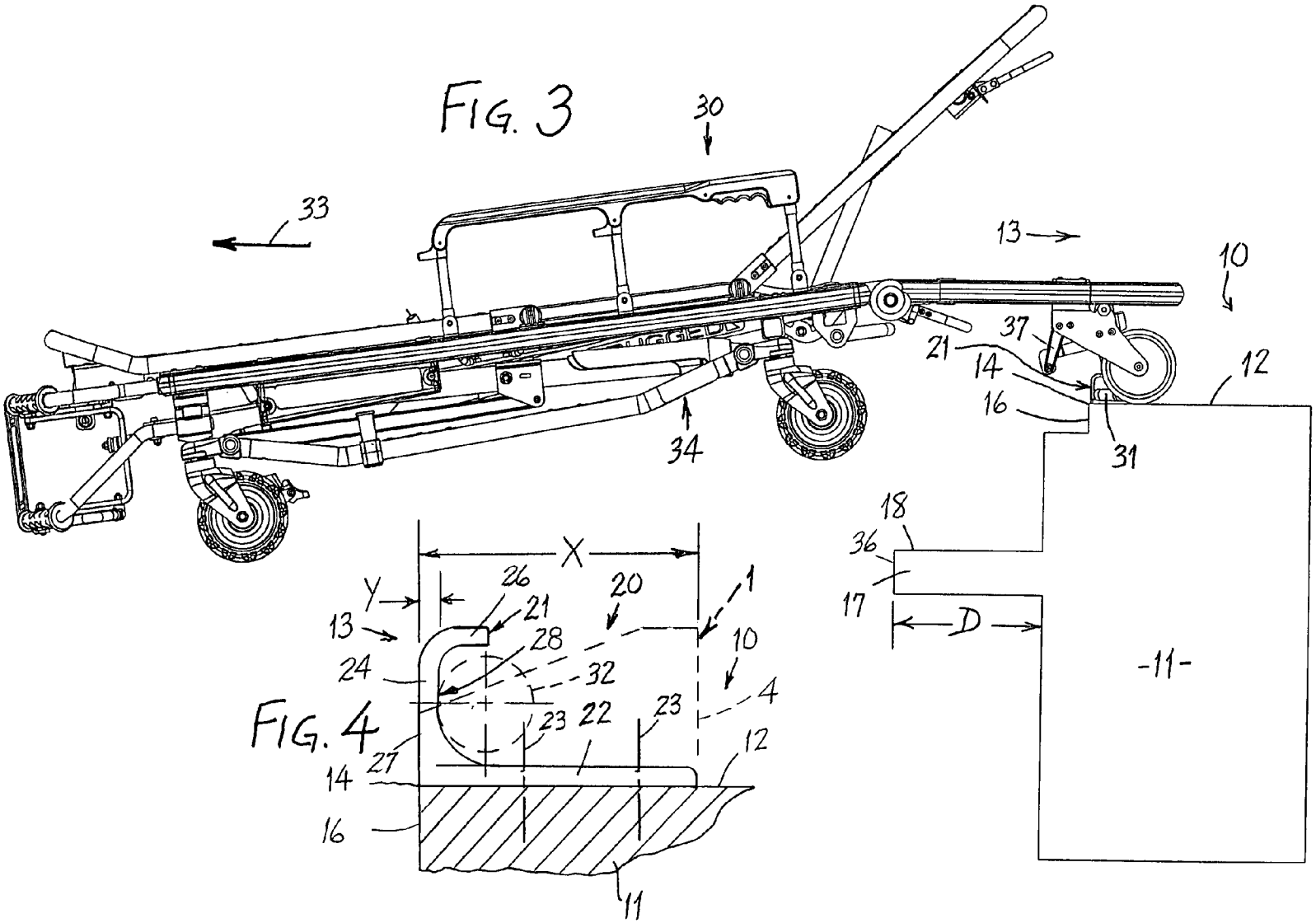
FIG. 3 is a side view of FIG. 2.
FIG. 4 is a fragmentary and enlarged sectional view of a safety stop member embodying the invention taken along the line IV—IV of FIG. 2.
Figure 5:
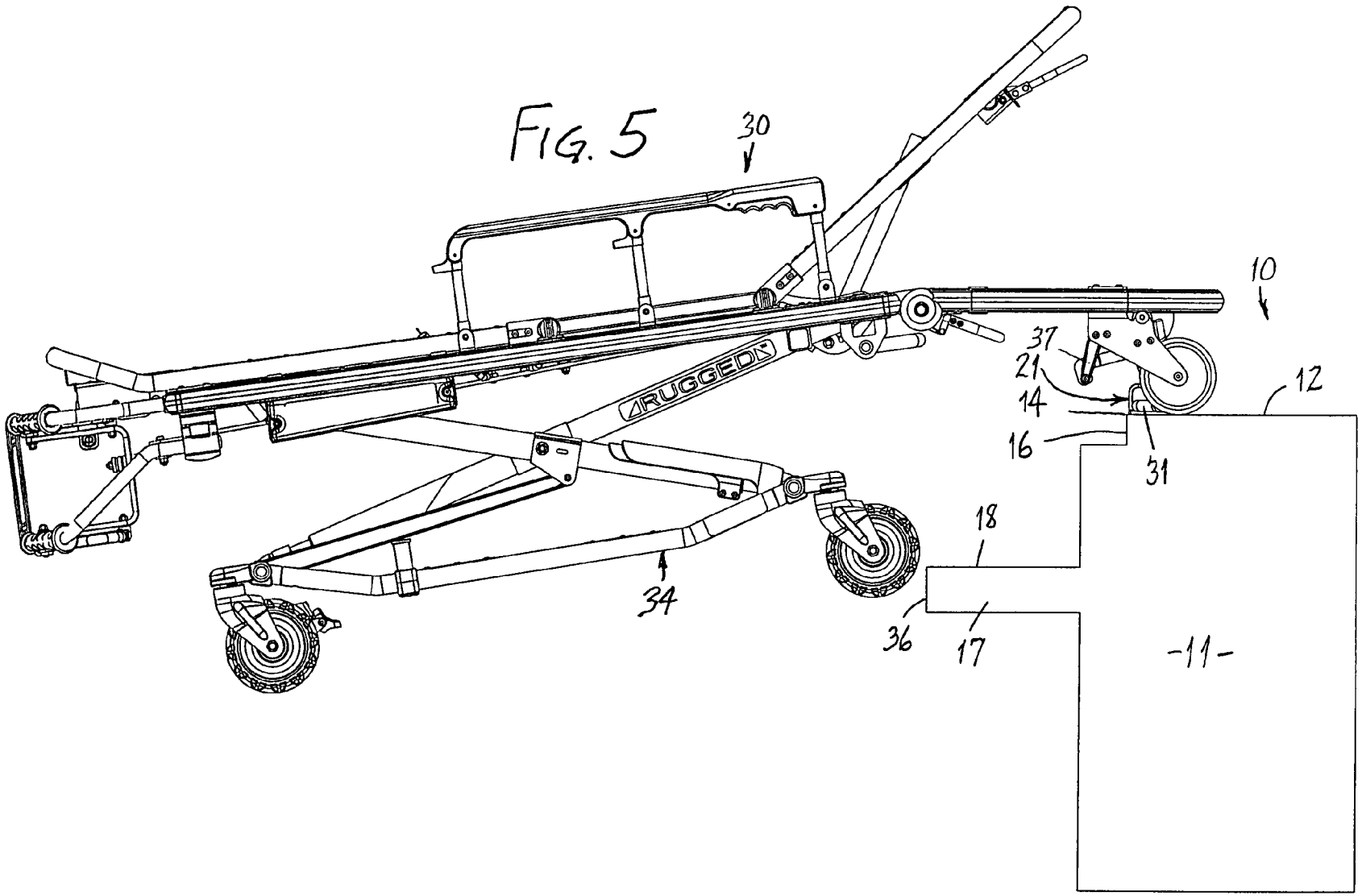
FIG. 5 is a side view similar to FIG. 3 and illustrating the base of the emergency cot in a partially deployed position.

FIG. 2 is an isometric view from inside a cargo area 10 of an emergency vehicle 11. The cargo area 10 includes a floor surface 12, an access opening 13 to the cargo area 10 and an edge 14 at the juncture between the floor surface 12 and the access opening 13. A door or the like (not illustrated) is generally provided on the emergency vehicle to close the access opening 13, the door becoming somewhat sealed against the elements by engagement thereof with an outwardly, here a rearwardly facing surface 16 (FIG. 3).

In this particular embodiment, a step 17 is provided on the emergency vehicle 11 immediately adjacent the access opening 13 and the upper surface 18 thereof is oriented generally a finite distance below the floor surface 12 inside the cargo area 10 of the emergency vehicle 11. The top surface 18 of the step 17 is generally of a sufficient depth to accommodate a large shoe size worn by emergency personnel. In this particular embodiment, the depth D of the step 17 is generally 10 inches. Known steps on emergency vehicles have a depth that is generally in the range of 5 to 13 inches.

A safety stop member 20 embodying the invention consists of a unitary L-shaped member 21. The L-shaped member 21 has a first leg 22 of generally uniform thickness secured to the floor surface 12 by a plurality of fasteners schematically indicated at 23. The L-shaped member 21 includes a second leg 24 oriented at one end of the leg 22 and is upstandingly arranged relative to the leg 22 and the floor surface 12 as illustrated in FIG. 4. The upper end of the second leg 24 is arced inwardly of the cargo area 10 to define a flange 26 extending generally parallel to and above the leg 22. The second leg 24 and the flange 26 thereon form a hook-like configuration. The side 27 of the second leg 24 on a side thereof remote from the leg 22 is oriented generally flush with the surface 16 on the emergency vehicle. Further, the thickness "Y" of the second leg 24 at a mid-height level thereof is generally within the range of 0.2 to 0.3 inches, the preferred dimension being generally 0.250 inches.

The emergency cot 30 illustrated in the drawings is representative of a typical type of emergency cot having a safety bar 31 pivotally supported thereon. Another representative example of an emergency cot having a safety bar is disclosed in U.S. Pat. No. 5,537,700, the subject matter of which is incorporated herein by reference. A central segment 32 of the safety bar 31 is configured to engage an inwardly facing surface 28 of the safety stop member 20 as the emergency cot rolls on its wheels in a direction out of the cargo area 10 through the access opening 13 as depicted by the arrow 33 in FIG. 3. The segment 32 of the safety bar 31 engaging the inwardly facing surface 28 of the second leg 24 of the safety stop member 20 is illustrated in broken lines in FIG. 4. In the prior art, the segment 32 would have engaged the prior art safety stop member 1 at the surface 4 approximately a distance X (2 to 3.5 inches) from the edge 14 of the opening 13 into the cargo area 10. It is immediately evident that the segment 32 engaging the inwardly facing surface 28 of the upstanding second leg 24 at a distance Y (0.2 to 0.3 inches, preferably 0.250 inches) from the edge 14 means that the emergency cot 30 can extend further out of the access opening 13 as depicted in FIGS. 3–6. Since the depth D of the rear step 17 is longer than other known steps on certain other emergency vehicle configurations, we have been able to accommodate the deeper rear step 17 without necessitating an alteration to the construction and configurations on the emergency cot. Furthermore, we have discovered that the inventive safety stop member 20 can be retrofitted into the cargo area of existing emergency vehicle configurations if it is desired to do so.

Figure 6:
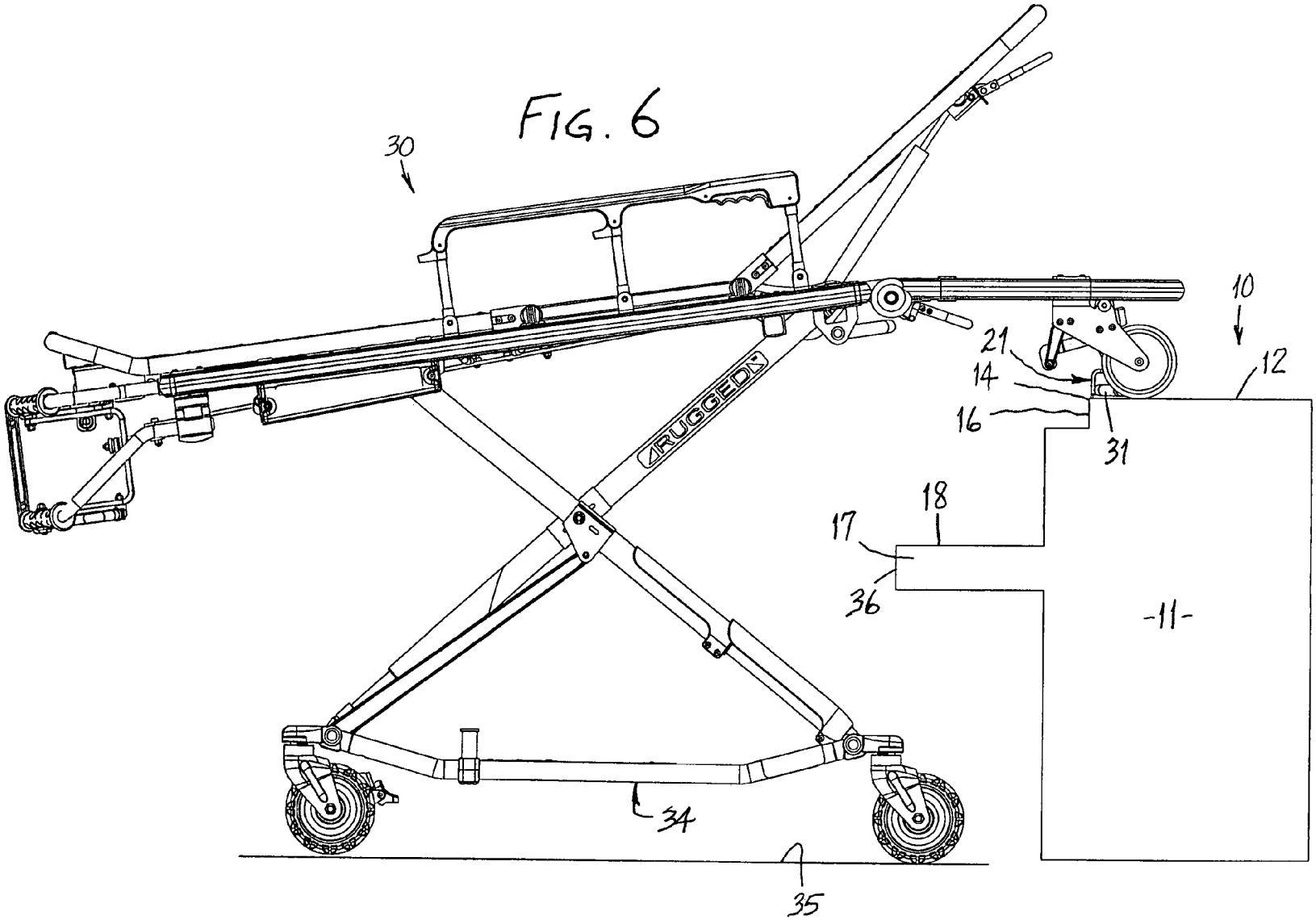
FIG. 6 is a side view similar to FIG. 5 with the base of the emergency cot being fully deployed.
Figure 7:
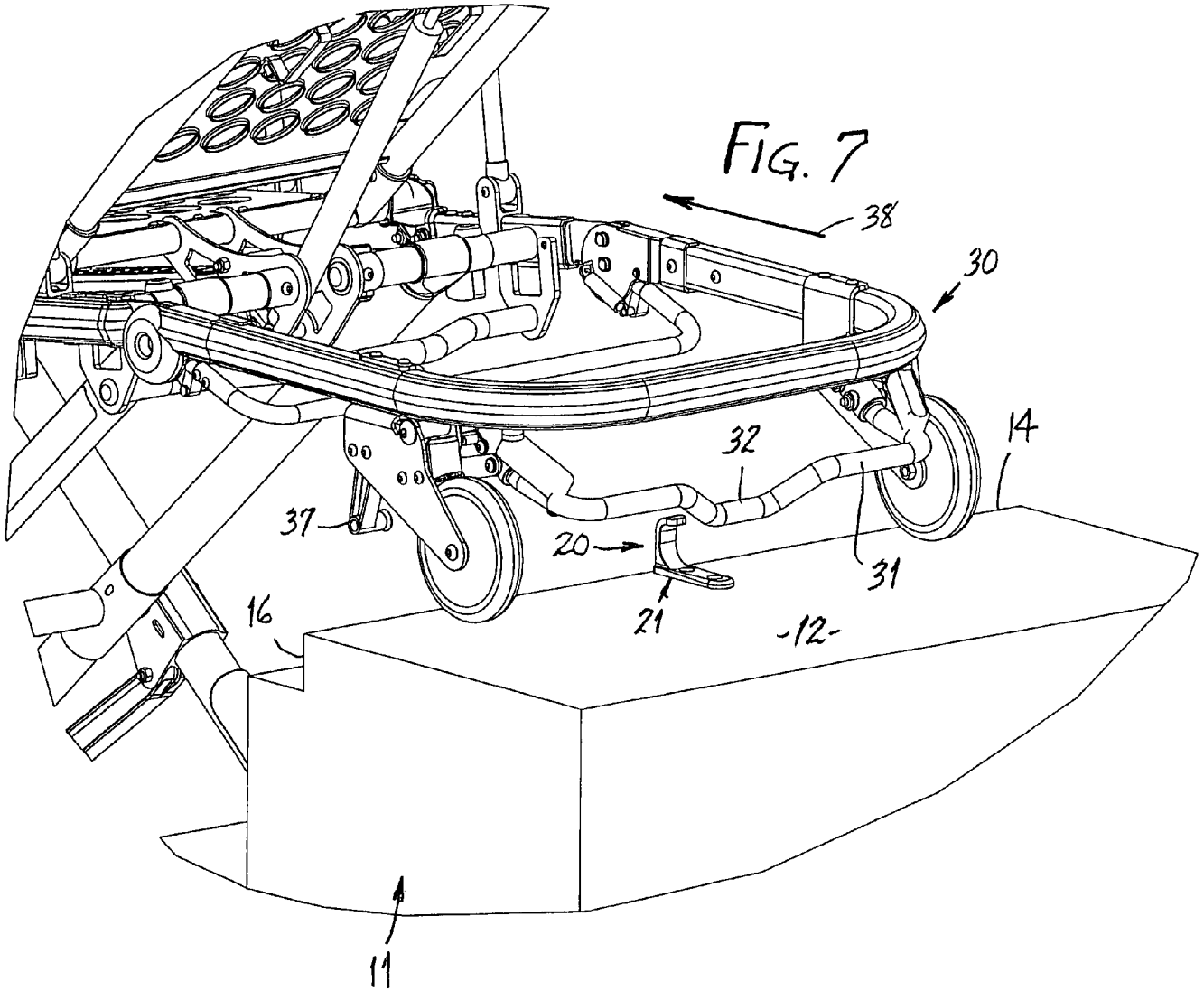
FIG. 7 is an isometric view similar to FIG. 2, but with the safety bar having been moved to a second position thereof to facilitate continued movement of the emergency cot out of the cargo area of the emergency vehicle.

FIGS. 3–6 illustrate the base 34 of the emergency cot 30 being oriented to extend outwardly of an outermost, here rearwardly of a rearwardly facing surface 36 of the step 17 to enable the base to be moved without interference by the step 17 from its collapsed position illustrated in FIG. 3 to its fully deployed position illustrated in FIG. 6. Following an engagement of the wheels on the base 34 with a ground surface 35, a handle 37 conventionally provided on the emergency cot 30 can be manipulated by the emergency personnel to effect a movement of the safety bar 31 from the position illustrated in FIG. 2 to a raised out of the way position illustrated in FIG. 7 to enable the emergency cot to be moved on its wheels away from the access opening 13 as depicted by the arrow 38 in FIG. 7.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In a device for preventing an emergency vehicle step bumper from interfering with an emergency cot wheel deployment, the emergency vehicle including an enclosed cargo carrying structure having a floor surface and an access opening through which personnel and at least one emergency cot can move, said floor surface terminating in an outwardly facing, downwardly extending wall at said access opening whereat an edge is defined, a step bumper projecting outwardly from the emergency vehicle a finite distance from said downwardly extending wall and at a location oriented beneath a plane of said floor surface, an emergency cot having a patient support deck and a collapsible wheel supported base on which is mounted said patient support deck, said collapsible wheel supported base being configured for movement to and between a first position wherein said base is collapsed and a second position wherein said base is deployed, said emergency cot including at one end thereof a laterally extending safety bar configured to be oriented close to said floor surface when said cot is inside said cargo carrying structure and said base is in said first position; and a safety stop member oriented on said floor surface and configured to interfere with said safety bar as said cot is moved with said wheels engaging said floor surface out of said cargo carrying structure to stop said outward movement while at least one wheel of said emergency cot still rests on said floor surface, the improvement wherein said safety stop member consists of an L-shaped member, a means for fastening a first leg of the L to said floor surface, a second leg of the L being oriented in an upstanding relation relative to said first leg and to said floor surface and configured so that said upstanding second leg will interfere with and engage said safety bar only when said safety bar is positioned adjacent a juncture between said first and second legs, an outward facing side of said second leg being oriented generally flush with said edge so that when said emergency cot extends outwardly from said access opening in said cargo carrying structure and said safety bar engages said second leg, said base on said cot will be sufficiently spaced outwardly of an outermost facing surface of said step bumper to facilitate an unobstructed deployment of said base to said second position thereof.

2. The improvement according to claim 1, wherein at least one of said plural fasteners is oriented, when said safety bar engages said second leg, on a side of said safety bar remote from said second leg.

3. The improvement according to claim 1, wherein a thickness of said second leg is in a range of 0.2 to 0.3 inches.

4. The improvement according to claim 3, wherein said thickness of said second leg is 0.250 inches.

5. The improvement according to claim 1, wherein axes of all of said fasteners are oriented, when said safety bar engages said second leg, on a side of a theoretical vertical center line of said safety bar remote from said second leg.

* * * * *